US008899780B2

(12) United States Patent
Maxik et al.

(10) Patent No.: US 8,899,780 B2
(45) Date of Patent: Dec. 2, 2014

(54) CONFIGURABLE LINEAR LIGHT ASSEMBLY AND ASSOCIATED METHODS

(71) Applicant: Lightning Science Group Corporation, Satellite Beach, FL (US)

(72) Inventors: Fredric S. Maxik, Cocoa Beach, FL (US); Addy S. Widjaja, Palm Bay, FL (US); Mark Andrew Oostdyk, Cape Canaveral, FL (US); Robert R. Soler, Cocoa Beach, FL (US); David E. Bartine, Cocoa, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 0 days.

(21) Appl. No.: 13/874,748

(22) Filed: May 1, 2013

(65) Prior Publication Data

US 2014/0328055 A1 Nov. 6, 2014

Related U.S. Application Data

(60) Provisional application No. 61/643,310, filed on May 6, 2012.

(51) Int. Cl.

| | |
|---|---|
| ***F21S 4/00*** | (2006.01) |
| ***F21V 21/005*** | (2006.01) |
| ***F21V 29/00*** | (2006.01) |

(52) U.S. Cl.

CPC ..... *F21V 21/005* (2013.01); *F21V 29/004* (2013.01)

USPC ..... 362/225; 362/218

(58) Field of Classification Search

CPC .... F21Y 2103/003; F21L 4/027; F21S 4/003; F21S 4/008; F21V 19/001; F21V 19/042; F21V 19/02; F21V 19/045; F21V 29/2237; F21V 29/2212

USPC ..... 362/217.01–220, 225

See application file for complete search history.

(56) References Cited

U.S. PATENT DOCUMENTS

| | | | | |
|---|---|---|---|---|
| 1,703,524 | A | 2/1929 | Grandjean | |
| 3,706,882 | A | 12/1972 | Eby | |
| 4,999,755 | A * | 3/1991 | Lin | 362/217.02 |
| 7,674,010 | B2 * | 3/2010 | Griffiths et al. | 362/249.02 |
| 7,686,480 | B2 * | 3/2010 | Chien et al. | 362/294 |
| 7,815,341 | B2 | 10/2010 | Steedly et al. | |
| 7,828,465 | B2 | 11/2010 | Roberge et al. | |
| 7,936,561 | B1 | 5/2011 | Lin | |
| 7,985,006 | B2 | 7/2011 | Chang et al. | |

(Continued)

*Primary Examiner* — Julie Bannan

(74) *Attorney, Agent, or Firm* — Mark R. Malek; William A. Harding; Zies Widerman & Malek

(57) ABSTRACT

A linear light assembly having an elongate tray and a plurality of moveable lighting packages. The elongate tray may provide both mechanical support and thermal management for the plurality of moveable lighting packages. The elongate tray may comprise a medial channel portion with a planar track member and two opposing rim members projecting perpendicularly outward therefrom. Each flange portion may have a U-shaped cross-section. Each moveable package may comprise an assembly tray and an optical assembly having at least one light-emitting device (LED). Each moveable lighting package may be adjustably positioned along and independently removed from the front side of the track member of the elongate tray. Any segmentation of the elongate tray may be characterized by a heat dissipation rate not less than a combined heat generation rate of all moveable lighting packages carried by the segment. A method aspect includes installation of the linear light assembly.

20 Claims, 10 Drawing Sheets

(56) References Cited

U.S. PATENT DOCUMENTS 8,109,652 B2 * 2/2012 Chen ..... 362/249.02
8,267,540 B2 9/2012 Kluš
2006/0146531 A1 * 7/2006 Reo et al. ..... 362/244
2010/0103672 A1 4/2010 Thomas et al.
2010/0271834 A1 10/2010 Muessli

* cited by examiner

CONFIGURABLE LINEAR LIGHT ASSEMBLY AND ASSOCIATED METHODS

RELATED APPLICATIONS

This application claims the benefit of U.S. Provisional Patent Application Ser. No. 61/643,310 filed on May 6, 2012 and titled Configurable Linear Light and Associated Methods, the entire contents of which are incorporated herein by reference.

FIELD OF THE INVENTION

The present invention relates to the field of illumination devices and, more specifically, to the field of light-emitting diode (LED)-based linear illumination devices, and associated methods.

BACKGROUND OF THE INVENTION

Linear-type illumination devices typically are characterized by multiple light sources mounted and spaced apart from one another along a length of an elongate substrate. Such illumination devices are often designed to present a low profile when installed flush to an existing surface, such as a wall.

Current linear illumination device designs commonly consist of multiple members that often are complex to manufacture and assemble. For example, linear illumination device components may include light sources, circuit boards, power supplies, heat sinks, support structures, electrical connectors, external housings, enclosures/reflectors, and inter-member fasteners. Design complexity may negatively impact both the manufacturability and the ease of installation of linear illumination devices.

More specifically, design complexity may complicate volume manufacturing of illumination products, which often involves collaboration between Original Equipment Manufacturers (OEMs) and Value Added Resellers (VARs). As used herein, an OEM is a company whose capital goods are used as components in other companies' finished consumer goods. A VAR is a company that builds and sells a finished consumer good using an OEM's components. The OEM often will customize component designs based on a VAR's requirements. Complexity of design in a component and/or a finished consumer good often results in error-prone and time-consuming assembly processes, and may make separation of distinct product manufacturing responsibilities among OEMs and VARs unworkably difficult.

A major design decision that may significantly impact illumination product cost and complexity is selection of the type of light sources to include in the product. For example, digital lighting technologies such as light-emitting diodes (LEDs) offer significant advantages over legacy light sources such as incandescent and fluorescent lamps. These advantages include, but are not limited to, better lighting quality, longer operating life, and lower energy consumption. Consequently, LED-based lamps increasingly are being used not only in original product designs, but also in products designed to replace legacy light sources in conventional lighting applications such as linear lighting devices. However, a number of design challenges and costs are associated with replacing traditional lamps with LED illumination devices. These design challenges include thermal management, installation ease, and manufacturing cost control.

The complex designs of current LED-based linear illumination devices often suffer from high material and component costs, and also from cumbersome component configurations that may sacrifice lighting adjustability and limit customization options. Design decisions that fix the positions or interrelationships between members of a linear illumination device can compromise the ability of a manufacturer and/or an installer to tailor or reconfigure the device to meet a consumer's lighting performance requirements.

The lighting industry is experiencing advancements in LED applications, some of which may be pertinent to improving the design of linear illumination devices.

U.S. Pat. No. 7,815,341 to Steedy et al. discloses a low-profile strip illumination device having a substrate supporting an elongate heat conductor as well as positively and negatively charged elongate rails. A plurality of LEDs are mounted so as to be powered by the elongate rails, and so as to define a heat flow path from each LED through the elongate heat conductor and to the environment. However, relying on separate components for mechanical support (i.e., the substrate) and for thermal management (i.e., the elongate heat conductor) adds to design complexity for the disclosed device.

U.S. Pat. No. 8,267,540 to Klus discloses a linear lighting apparatus that includes an elongated element having a substantially U-shaped cross section and an LED strip placed longitudinally along a bottom of the elongated element. However, the depth of the U-shape elongated element presumes recessed mounting, thereby precluding low-profile flush-mounting applications. Also, the placement of LEDs on a common strip prevents reconfiguration and/or replacement of subsets of the LEDs employed in the linear lighting apparatus.

U.S. patent application Ser. No. 11/026,816 by Reo et al. discloses a linear lighting apparatus having a plurality of LEDs, a plurality of optical assemblies, and a housing. The apparatus housing is configured to hold a secondary optical assembly and to dissipate radiated energy from the LEDs. However, the depth of the U-shaped housing suffers the same recessed mounting disadvantage as the Klus implementation. Furthermore, delegating primary mechanical support of the optical assemblies to an LED tray while relying on the housing to provide primary thermal management for the optical assemblies results in a component proliferation problem similar to that exhibited by the Steedy implementation.

Accordingly, a need exists for a low-profile, LED-based linear illumination device that is less complex in design, less expensive to manufacture and assemble, reconfigurable during assembly and post-installation, and efficient at heat dissipation.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a linear light assembly used to produce a configurable beam of light emanating along a length of a luminaire. Embodiments of the present invention advantageously may provide an LED-based linear illumination device that is less complex in design, is less expensive to manufacture, is reconfigurable during assembly and post-installation, and is efficient with respect to heat dissipation.

These and other benefits, features and advantages are preferably provided by a linear light assembly according to embodiments of the present invention that may include an elongate tray and a plurality of moveable lighting packages.

The single-member, dual-purpose elongate tray may be configured to be employed advantageously to provide both mechanical support and heat dissipation during the operation of the moveable lighting packages. Each of the moveable lighting packages may be reconfigured during assembly and post-installation to advantageously adjust the direction of light emitted by at least one light source. Modularization of other components designed to mount to the elongate tray, including power supplies and custom finishes, may advantageously facilitate collaborative manufacturing of linear-type illumination devices among participating OEMs and VARs. More specifically, modularization may equip an OEM to efficiently and inexpensively produce a universal linear fixture, deliverable in various states of completeness of assembly and staged for finishing by several different VARs. VARs, in turn, may use universal linear fixtures produced by OEMs to tailor finished linear-type illumination devices for consumption by diverse customers.

The elongate tray may comprise a medial channel portion, and first and second flange portions. The medial channel portion may comprise a track member and two opposing rim members. The track member may have a substantially planar main body with generally flat front and rear sides and with upper and lower edges. The two opposing rim members may be positioned adjacent to the upper and lower edges of the track member. Each rim member may be longitudinally coextensive with the track member, and may be configured to project outward in a generally perpendicular direction with respect to the front side of the track member. The medial channel portion and the first and second flange portions may be integrally molded as a monolithic unit.

Each of the first and second flange portions may have a substantially U-shaped cross-section defined by a base member and fin members. The base member may comprise a substantially planar central body with generally flat first and second sides and with generally linear leading and trailing edges. The two opposing fin members may be positioned adjacent to the leading and trailing edges of the base member, respectively, and may be configured to project perpendicularly outward from the base member in a generally parallel direction with respect to the main body of the track member. The second sides of the base members of the first and second flange portions each may be attached to a respective rim member of the medial channel portion. Each of the first and second flange portions may be longitudinally coextensive with the track member.

Each of the plurality of moveable lighting packages may comprise an assembly tray and an optical assembly. The optical assembly may comprise at least one light source, and may be carried by the assembly tray. The optical assembly and the assembly tray may be integrally molded as a monolithic unit. A power supply may be in electrical communication with each light source. A generally central passageway may be formed between the assembly tray and the medial channel portion. An electrical connection may pass from the power supply through an aperture in the track member, and may extend through the central passageway to an electrical contact on each light source. Each light source may comprise a light emitting diode (LED).

The elongate tray may come into mechanical communication with each of the moveable lighting packages. More specifically, the elongate tray may further comprise a plurality of tray segments each in mechanical communication with a subset of the moveable lighting packages. Each of the moveable lighting packages may be moveably positioned along and independently removed from the front side of the track member. The elongate tray may include at least one mounting assembly, each of which may comprise fasteners, snap-fit connectors, and/or fitted grooves. The elongate tray may include mounting positions each suitable for mounting one of the moveable lighting packages to a mounting assembly. The elongate tray may be configured to mechanically connect to a housing and/or to a fixture.

The elongate tray may be positioned in thermal communication with each of the moveable lighting packages. The elongate tray may be characterized by a heat dissipation rate of not less than a combined heat generation rate of the moveable lighting packages. More specifically, the elongate tray may comprise a plurality of tray segments each in thermal communication with a subset of the moveable lighting packages. Each of the tray segments may have a heat dissipation rate of not less than a combined heat generation rate of the subset of the moveable lighting packages with which the try segment makes contact. The elongate tray may be constructed of a heat-dissipating material such as thermoplastic, ceramic, porcelain, aluminum, and aluminum alloys. The elongate tray may be configured to connect thermally to the housing such that a combined heat dissipation rate of the elongate tray and of the housing is not less than a combined heat generation rate of the packages.

A method aspect according to an embodiment of the present invention is for installing a linear light assembly. The method may comprise adjustably positioning each of the moveable lighting packages on the medial channel portion of the elongate tray, and affixing each of the moveable lighting packages to a respective mounting position. The installation method may further comprise moving a first subset of the moveable lighting packages to a respective mounting position on a first tray segment, removing a second subset of the moveable lighting packages from a second tray segment, separating the second tray segment from the first tray segment, and mounting the first tray segment to a light fixture. The installation method may still further comprise removing the power supply from the second tray segment, and mounting the power supply to the first tray segment.

DETAILED DESCRIPTION OF THE PREFERRED EMBODIMENT

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," "front," "rear," and other like terms are used for the convenience of the reader in reference to the drawings. Also, a person skilled in the art should notice this description may contain other terminology to convey position, orientation, and direction without departing from the principles of the present invention. Like numbers refer to like elements throughout.

Referring now to FIGS. 1-10, a linear light assembly 100 used to produce a configurable beam of light emanating along a length of a luminaire, according to an embodiment of the present invention, is now described in detail. Throughout this disclosure, the present invention may be referred to as a configurable linear light assembly 100, a strip illumination device, a light strip, a linear light, a lamp system, a lamp, a device, a system, a product, or a method. Those skilled in the art will appreciate that this terminology is only illustrative and does not affect the scope of the invention.

Example systems and methods for a configurable linear light assembly are described herein below. In the following description, for purposes of explanation, numerous specific details are set forth to provide a thorough understanding of example embodiments. It will be evident, however, to one of ordinary skill in the art that the present invention may be practiced without these specific details and/or with different combinations of the details than are given here. Thus, specific embodiments are given for the purpose of simplified explanation and not limitation.

Figure 1:
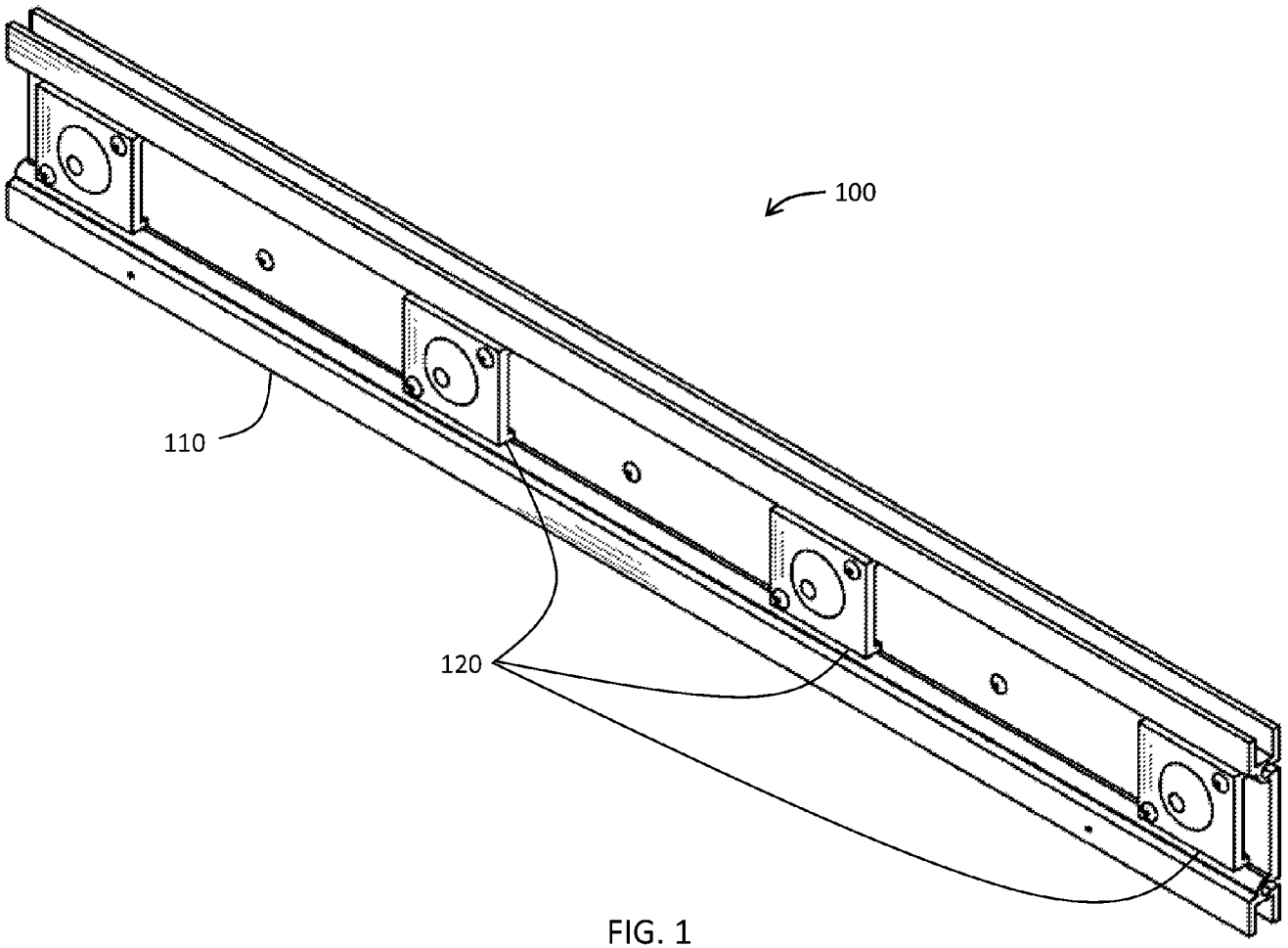
FIG. 1 is a perspective view of a linear light assembly according to an embodiment of the present invention.

Referring now to FIG. 1, a configurable linear light assembly 100 will now be discussed. The linear light assembly 100, according to an embodiment of the present invention, may include an elongate tray 110 and a plurality of moveable lighting packages 120. For example, and without limitation, the configurable linear light assembly 100 may advantageously be used as a low profile linear accent luminaire, suitable for indoor and/or outdoor applications. In addition, the linear light assembly 100 may advantageously be customizable in length.

Each of the moveable lighting packages 120 may be mounted upon the elongate tray 110. Although the configuration of the linear light assembly illustrated in FIG. 1 shows four moveable lighting packages 120 approximately equally spaced apart, the skilled artisan will appreciate that moveable lighting packages 120 may be positioned anywhere along the elongate tray 110 prior to being fastened thereto. The skilled artisan will further appreciate that any number of light packages 120 may be provided along the elongate tray 110, while still accomplishing the goals, features and objectives of the linear light assembly 100 according to an embodiment of the present invention. This spacing feature advantageously may enhance the flexibility of use of the linear light assembly 100. The components comprising the light assembly 100 may be connected by any means known in the art, including, not by limitation, use of adhesives or glues, welding, interference fit, and fasteners. Alternatively, one or more components of the light assembly 100 may be molded during manufacturing as an integral part of the light assembly 100.

Elongate Tray Configuration

Figure 2:
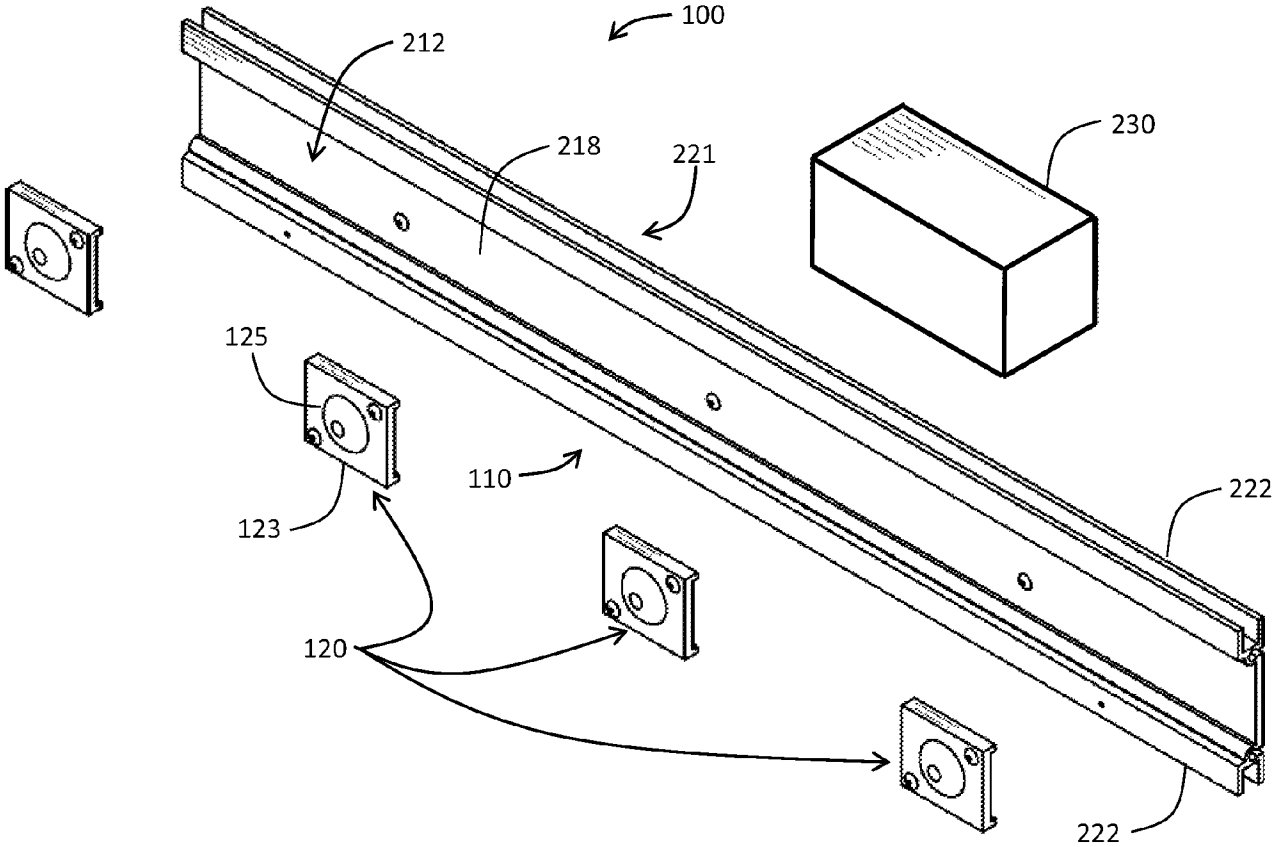
FIG. 2 is an exploded perspective view of the linear light assembly illustrated in FIG. 1.

Referring now to FIG. 2, the elongate tray 110 of the light assembly 100 according to an embodiment of the present invention is now discussed in greater detail. For example, and without limitation, the elongate tray 110 may comprise a medial channel portion 212, and first and second flange portions 222.

Figure 3:
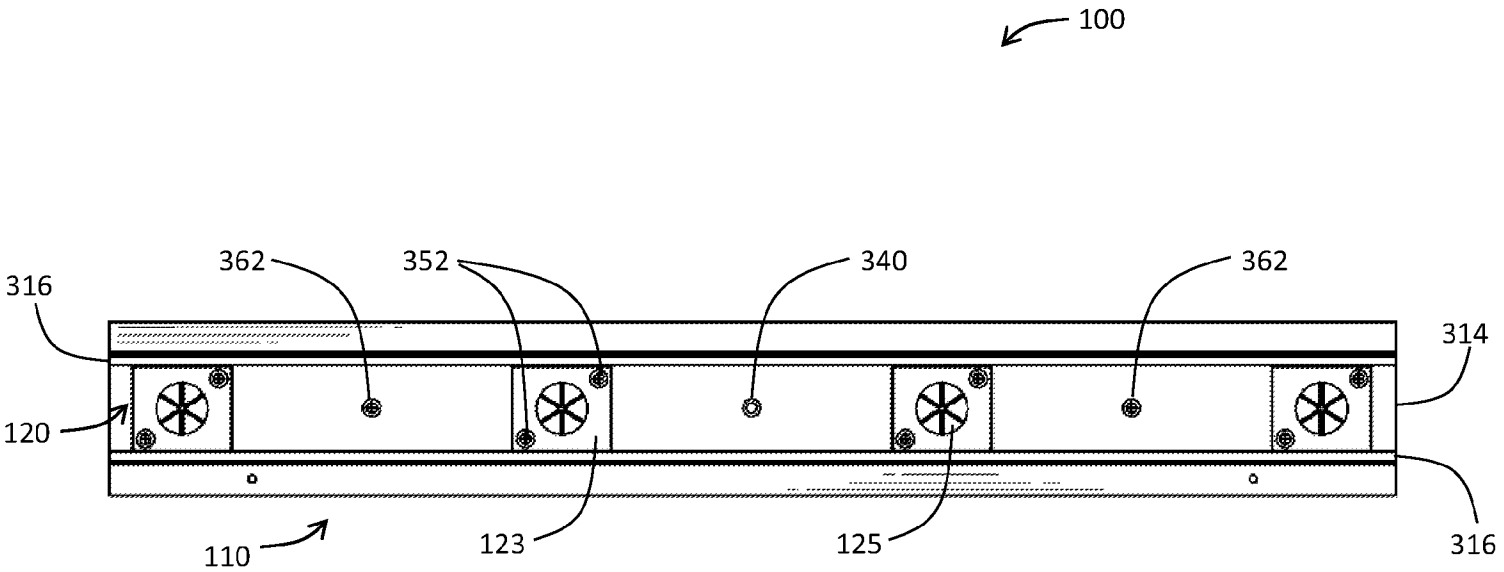
FIG. 3 is a front elevation view of the linear light assembly illustrated in FIG. 1.
Figure 5:
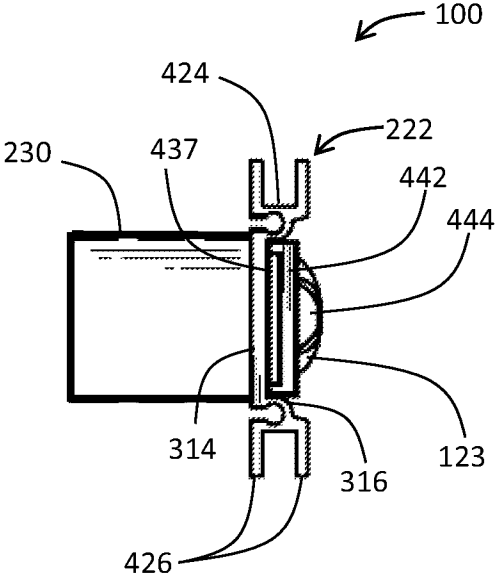
FIG. 5 is a left side elevation view of the linear light assembly illustrated in FIG. 1.
Figure 4:
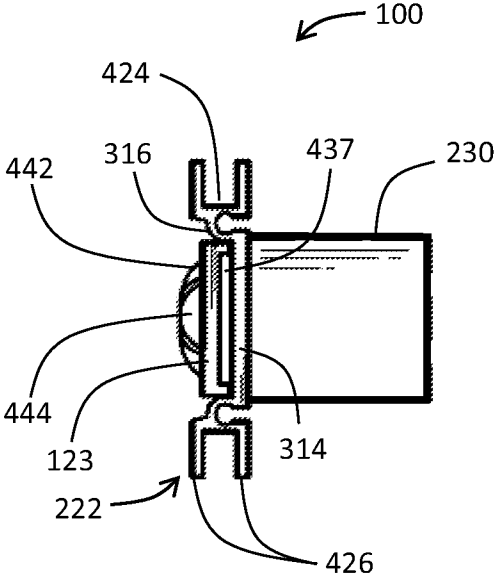
FIG. 4 is a right side elevation view of the linear light assembly illustrated in FIG. 1.

Continuing to refer to FIG. 2, and referring additionally to FIGS. 3, 4 and 5, the medial channel portion 212 may comprise a track member 314 and two opposing rim members 316. For example, and without limitation, the track member 314 may have a substantially planar main body with generally flat front 218 and rear sides and with upper and lower edges. Those skilled in the art will appreciate that a substantially planar main body is intended to note that the main body may have a shape that is planar. Those skilled in the art will also appreciate that shapes of the main body that are not precisely planar are meant to be included within the scope and spirit of the embodiments of the present invention. The two opposing rim members 316 may be positioned adjacent to the upper and lower edges of the track member 314. Each rim member 316 may be longitudinally coextensive with the track member 314, and may be configured to project outward in a generally perpendicular direction with respect to the front side 218 of the track member 314.

Continuing to refer to FIGS. 2, 4 and 5, each of the first and second flange portions 222 may have a substantially U-shaped cross-section defined by a base member 424 and two opposing fin members 426. Those skilled in the art will appreciate that use of the term "substantially" when describing the U-shaped cross section of the flange portions 222 is meant to be inclusive of shapes that are similar to a U-shaped shape, i.e., shapes that include a base member 424 and opposing fin members 426. It is to be understood that the opposing fin members 426 are contemplated to extend from the base member at any angle suitable for forming a U-shape. For example, the present invention contemplates that the fin members 426 may extend from the base member 424 at any angle between about 75 degrees and 105 degrees. Those skilled in the art will appreciate that these angles of extension of the fin members 426 from the base member 424 are exemplary in nature and not meant to be limiting in any way. The base member 424 may comprise a substantially planar central body with generally flat first and second sides and with generally linear leading and trailing edges. Those skilled in the art will appreciate that embodiments of the present invention also contemplate fins and second sides that are not precisely flat. The two opposing fin members 426 may be positioned adjacent to the leading and trailing edges of the base member 424, respectively, and may be configured to project perpendicularly outward from the base member 424 in a generally parallel direction with respect to the main body of the track member 314. The second sides of the base members 424 of the first and second flange portions 222 each may be attached to a respective rim member 316 of the medial channel portion 212. Each of the first and second flange portions 222 may be longitudinally coextensive with the track member 314.

For example, and without limitation, the medial channel portion 212 and the first and second flange portions 222 may be integrally molded as a monolithic unit. Also for example, and without limitation, the elongate tray 110 may have a maximum overall depth of 1 inch, measured as the distance between the leading and trailing edges of the widest of the base members 424 of the two flange portions 222. Also for example, and without limitation, the elongate tray 110 may have a maximum overall height of 5 inches, measured as the distance between outermost points on the fin members 426 of the first and second flange portions 222.

Moveable Lighting Package Configuration

Referring again to FIG. 2, the plurality of moveable lighting packages 120 of the light assembly 100 according to an embodiment of the present invention is now discussed in greater detail. Each moveable lighting package 120 may operate as a self-contained light-producing unit, and may comprise an assembly tray 123 and an optical assembly 125.

Referring additionally to FIGS. 4 and 5, the optical assembly 125 may comprise an optic 442 and at least one heat generating element 444. For example, and without limitation, the heat generating element 444 may be in the form of a light source that may include any device capable of emitting light. The light source may comprise one or more light emitting elements that may, for example and without limitation, include light-emitting semiconductors, such as light-emitting diodes (LEDs), lasers, incandescent, halogens, arc-lighting devices, fluorescents, and any other digital light-emitting device known in the art. In some embodiments of the present invention, the light source may include one or more LEDs 444 and a circuit board (not shown). The circuit board may be configured to be functionally and/or mechanically coupled to the LEDs 444.

LEDs normally produce singular points of light. However, the linear light assembly 100 according to an embodiment of the present invention may be configured to refract light produced from one or more LEDs 444 in such a way as to produce a continuous linear beam of light emanating along a length of the linear light assembly 100. Such a beam of light may be useful, for example, in building grazing applications or wall washing lighting effects. The optic 442 that may be included in the optical assembly 125 may be configured to interact with light emitted by the LEDs 444 to refract incident light. Accordingly, the LEDs 444 may be disposed such that light emitted therefrom is incident upon the optic 442. The optic 442 may be formed in any shape to impart a desired refraction. For example, and without limitation, the optic 442 may have a generally concave geometry. Additionally, the optic 442 may be configured to generally diffuse light incident thereupon, and from a material that refracts or collimates light emitted by the LEDs 444.

The optic 442 may be formed of any material with transparent or translucent properties that comport with the desired refraction to be performed by the optic 442. For example, the optic 442 may include an extruded refractory material. Alternatively, or in addition, an exemplary material for the optic 442 may be an acrylic material, such as cast acrylic or extruded acrylic. In addition, the optic 442 may be formed of cast acrylic with diamond polishing. Acrylic materials may be suitable for the optic 442 due to their excellent light transmission and UV light stability properties.

Continuing to refer to FIGS. 2, 4 and 5, an external power source used to power the linear light assembly 100 according to an embodiment of the present invention is discussed in greater detail. For example, and without limitation, a power supply 230 may be mounted on the rear side 221 of the track member 314 and may be configured to be in electrical communication with one or more light sources 444 in the optical assembly 125. A generally central passageway 437 may be formed between the assembly tray 123 and the front side 218 of the track member 314 in the medial channel portion 212. Referring additionally to FIG. 3, an electrical connection may pass from the power supply 230 through an aperture 340 in the medial channel portion 212, and may extend through the central passageway 437 to an electrical contact on a light source 444, such as an LED.

For example, and without limitation, the power source 230 may be in the form of an on-board power supply unit configured to deliver electrical power to LEDs 444 present in the moveable lighting packages 120. The on-board power supply unit 230 may have a converter (not shown) that may convert an AC input voltage to a DC output voltage. The on-board power supply unit 230 also may have a regulator (not shown) that may sustain a DC output voltage within a target DC bias range.

In one embodiment, the on-board power supply unit 230 may have at least one induction coil (not shown) configured to receive an AC input voltage through inductive coupling. In another embodiment, the on-board power supply unit 230 may have at least one wire connector configured to receive the AC input voltage through conductive coupling. Alternatively, the power source 230 may be in the form of at least one power terminal (not shown) that receives power from a source external to the linear light assembly 100, and that transmits that electrical power to the light sources 444 and/or other electronic components comprising the moveable lighting packages 120. Additional information directed to the use of power sources to deliver electric current to an illumination apparatus is found in U.S. patent application Ser. No. 13/608,999 titled System for Inductively Powering an Electrical Device and Associated Methods, the entire contents of which are incorporated herein by reference.

Mechanical Communication

Referring again to FIGS. 2 and 3, the mechanism by which the elongate tray 110 may come into mechanical communication with each of the plurality of moveable lighting packages 120 of the light assembly 100 according to an embodiment of the present invention is now discussed in greater detail. A person skilled in the art will appreciate that any manner of mounting a moveable lighting package 120 on the elongate tray 110 may be used.

The optical assembly 125 of each LED package 120 may be carried by the assembly tray 123. A person skilled in the art will appreciate that each assembly tray 123 may be bonded to an optical assembly 125 using any manner of bonding. For example, and without limitation, the optical assembly 125 and the assembly tray 123 may be integrally molded as a monolithic unit.

Each of the plurality of moveable lighting packages 120 may be configured to be both moveably positioned along and independently removed from the front side 218 of the track member 314. For example, and without limitation, each assembly tray 123 may include a snap-fit connection to the recessed track member 314 of the elongate tray 110. In another example, each assembly tray 123 may be slid onto the recessed portion 218 of the track member 314 from one end of the elongate tray 110.

Figure 6:
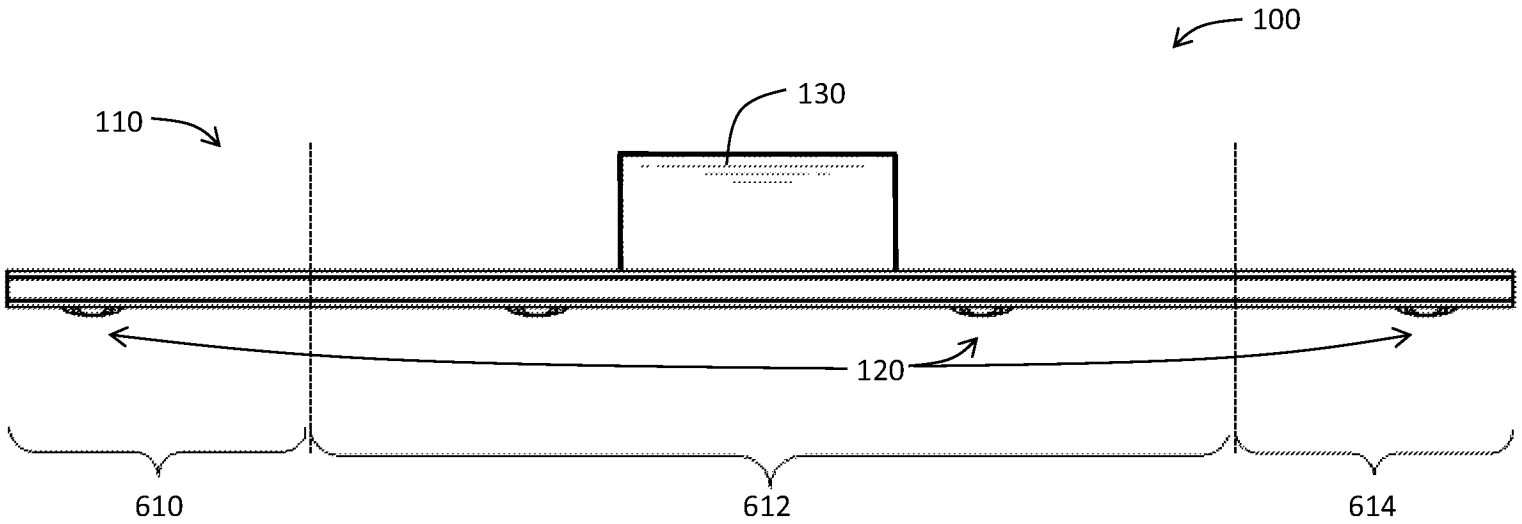
FIG. 6 is a top plan view of the linear light assembly illustrated in FIG. 1.
Figure 7:
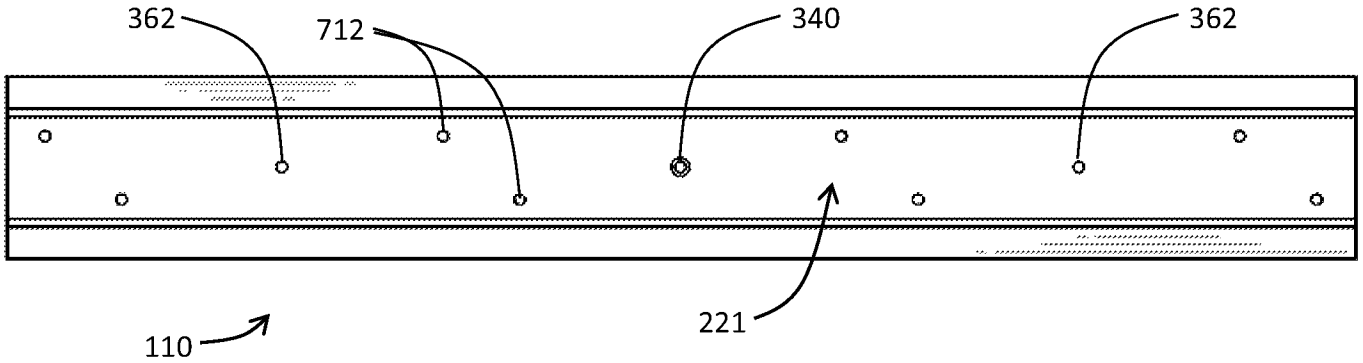
FIG. 7 is a rear elevation view of an elongate LED tray of the linear light assembly illustrated in FIG. 1.

Referring additionally to FIGS. 6 and 7, the elongate tray 110 may further comprise a plurality of tray segments 610, 612, 614 each in mechanical communication with a subset of the plurality of moveable lighting packages 120. The elongate tray 110 may comprise at least one mounting assembly each configured to receive a respective moveable lighting package 120. For example, and without limitation, the mounting assembly may comprise fasteners, such as one or more screws 352 each positionable through a respective screw hole in one of the assembly trays 123 and configured to mate with a respective bore hole 712 in the elongate tray 110. Alternatively, or in addition, a mounting assembly also may comprise snap-fit connectors, such as snap-fit tabs (not shown) each attached to one of the assembly trays 123 and configured to mate with a respective notch (not shown) in the elongate tray 110. Alternatively, or in addition, the mounting assembly also may comprise fitted grooves (not shown), which may comprise a channel positioned adjacent the front side 218 of the track member 314 and along a length of each of the rim members 316 so as to receive each of the assembly trays 123.

The linear light assembly 100 according to embodiments of the present invention therefore may provide a very simple and fast mechanism by which optical assemblies 125 and/or assembly trays 123 (as described above) may be replaced or repaired. For example, and without limitation, assembly trays 123 may be slid off of or otherwise removed from the tray 110 in order to replace or repair the assembly tray 123 and/or the optical assembly 125.

Figure 8:
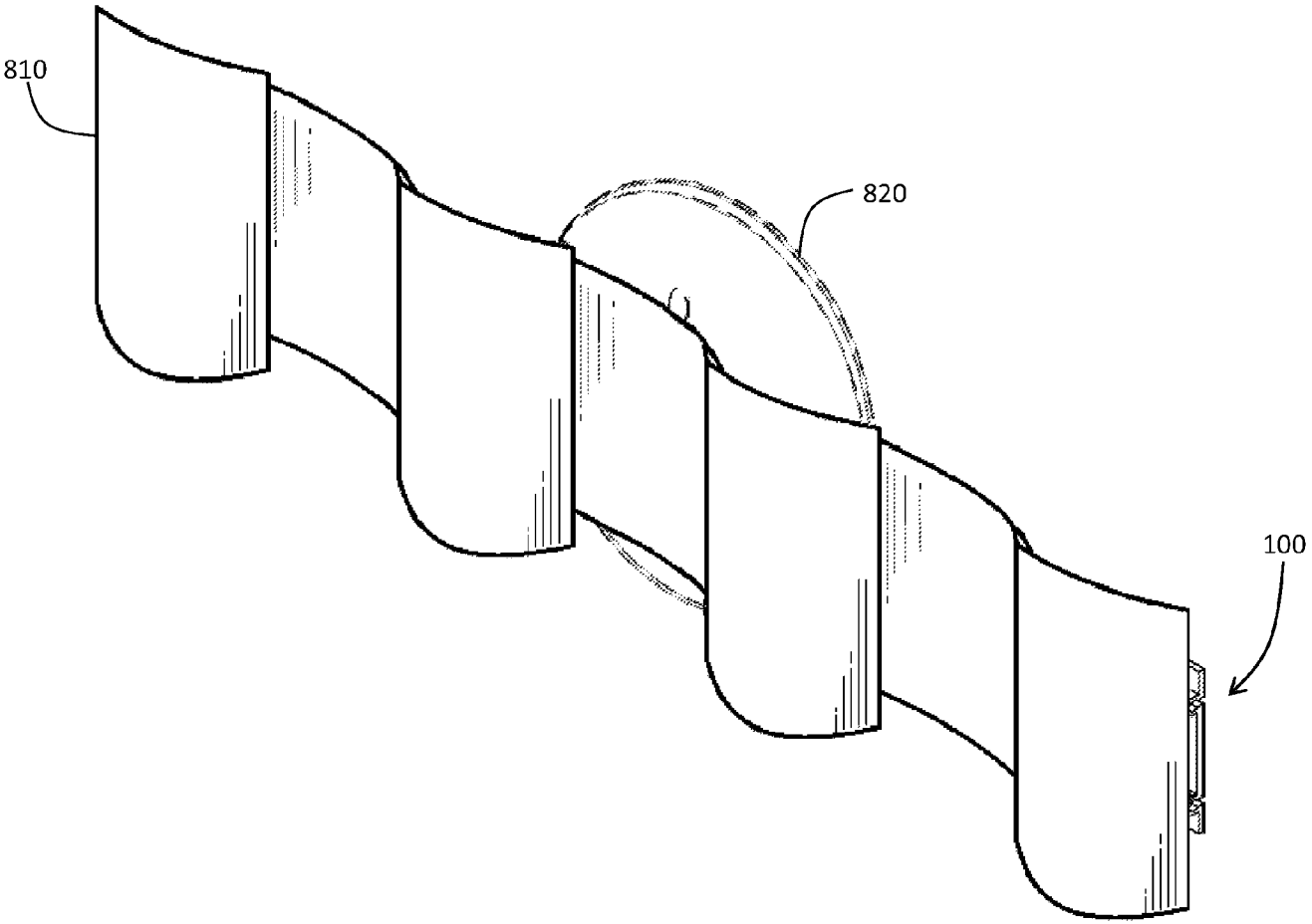
FIG. 8 is a perspective view of the linear light assembly illustrated in FIG. 1, and showing the linear light assembly connected to an optional housing and to an optional fixture.
Figure 9:
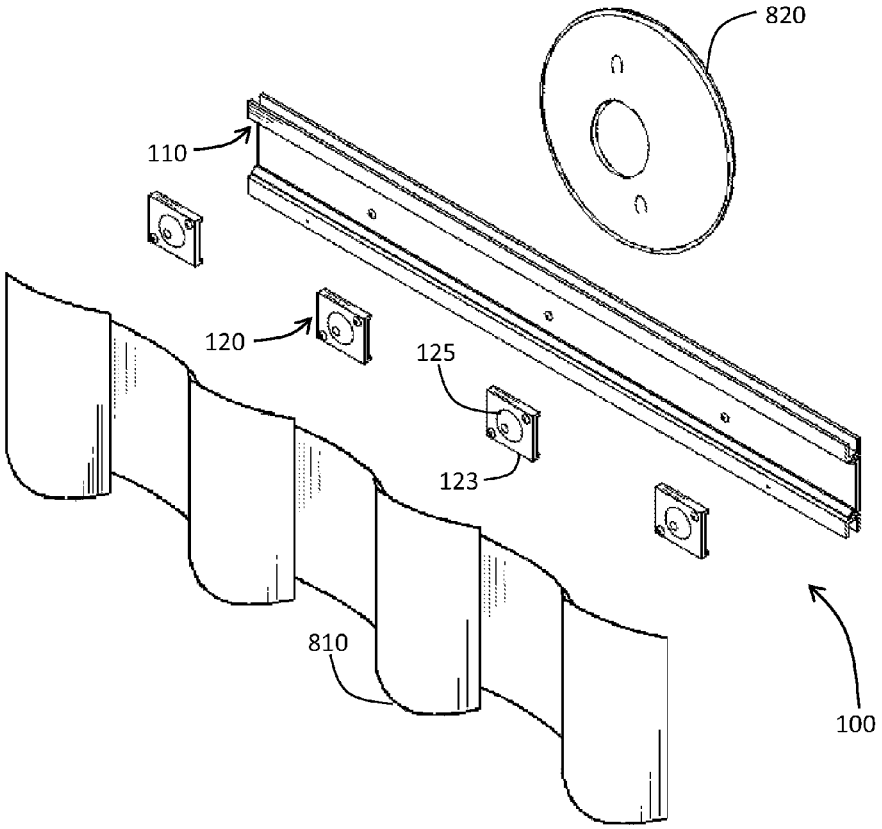
FIG. 9 is an exploded perspective view of the linear light assembly and optional housing and optional fixture illustrated in FIG. 8.

Referring additionally to FIGS. 8 and 9, the elongate tray 110 may be configured to connect mechanically to a housing 810 and/or a fixture 820. For example, and without limitation, the linear light assembly 100 may be mounted in an after-market housing, such as a decorative finish, using a complementary mechanical connection mechanism that may be present in the housing. Also for example, and without limitation, the elongate tray 110 may comprise one or more mounting holes 340 to support attachment of the linear light assembly 100 to a standard light fixture 820, and/or may include finish holes 362 to support attachment of a compatible housing 810 to the linear light assembly 100.

Thermal Communication

Referring again to FIG. 2, the mechanism by which the elongate tray 110 may come into thermal communication with each of the plurality of moveable lighting packages 120 of the light assembly 100 according to an embodiment of the present invention is now discussed in greater detail. A person skilled in the art will appreciate that any manner of dissipating heat from a moveable lighting package 120 on the elongate tray 110 may be used.

Continuing to refer to FIG. 2, and referring additionally to FIGS. 4 and 5, the elongate tray 110 may act as a heat sink that may dissipate thermal energy generated by the moveable lighting packages 120 to advantageously improve the performance and increase the lifespan of the linear light assembly 100. More specifically, each assembly tray 123 may be mounted on an elongate tray 110 that may be formed of a thermally conductive material. Heat generated by one or more light sources 444 within the optical assembly 125 may therefore be conducted, or passed, to the elongate tray 110.

*For example, and without limitation, the medial channel portion 212 may be positioned adjacent the LED package 120 and may be thermally coupled to the light source 444. This thermal coupling may be accomplished by any method, including thermal adhesives, thermal pastes, thermal greases, thermal pads, and all other methods known in the art. Where a thermal adhesive, paste, or grease is used, the medial channel portion 212 may be connected to any part of the moveable lighting package 120 as may effectively cause thermal transfer between the light source 444 and the elongate tray 110. Connection point location largely may depend on the heat distribution within the light source 444. For example, the medial channel portion 212 may be thermally coupled to one or more LEDs 444, to the circuit board (not shown), or to both so as to increase the thermal dissipation capacity of the lighting device 100. The method of thermal coupling may be selected based on criteria including ease of application/installation, thermal conductivity, chemical stability, structural stability, and constraints placed by the linear light assembly 100.

Continuing to refer to FIGS. 4 and 5, the first and second flange portions 222 may each present two opposing fin members 426 which, as understood in the field of heat sinks, may be used to dissipate heat generated by operation of the light source 444. The fin members 426 may provide a larger surface area that may otherwise be provided by the surface of the assembly tray 123 and medial channel portion 212 through which heat may be readily dissipated. Employment of multiple fin members 426 may increase the surface area of the elongate tray 110 and may permit thermal fluid flow between adjacent fin members 426, thereby enhancing the cooling capability of the elongate tray 110. Additionally, multiple fin members 426 may be identical in shape. Those skilled in the art will readily appreciate, however, that the fin members 426 of the elongate tray 110 may be configured in any way while still accomplishing the many goals, features and advantages according to the present invention.

The configuration of the fin members 426 may be as described above, or according to the direction of the incorporated references. In the embodiment of the invention illustrated in FIGS. 4 and 5, the fin members 426 may be configured to extend substantially the length of the elongate tray 110 (i.e., longitudinally coextensive with the track member 314) and to project perpendicularly outward from the base member 424 in a generally parallel direction with respect to the main body of the track member 314. Those skilled in the art will appreciate, however, that the present invention contemplates the use of fin members 426 that extend any distance, and that the disclosed elongate tray 110 that includes fin members 426 that extend substantially the length thereof is not meant to be limiting in any way. Those skilled in the art will also appreciate that use of the term "substantially" with respect to the fin members is meant to indicate that the fin members 426 of the elongate tray 110 may extend a length that is equal to the length of the elongate tray or slightly less than the length of the elongate tray. For the sake of clarity, fin members 426 that extend a length slightly less than the elongate tray 110 are meant to include fin members that have a length anywhere between 50% of the length of the elongate tray to 99% of the length of the elongate tray.

The medial channel portion 212 and the first and second flange portions 222 of the elongate tray 110 may be made by molding, casting, or stamping of a thermally conductive material. Materials may include, without limitation, thermoplastic, ceramics, porcelain, aluminum, aluminum alloys, metals, metal alloys, carbon allotropes, and composite materials. Additional information directed to the use of heat sinks for dissipating heat in an illumination apparatus is found in U.S. Pat. No. 7,922,356 titled Illumination Apparatus for Conducting and Dissipating Heat from a Light Source, and U.S. Pat. No. 7,824,075 titled Method and Apparatus for Cooling a Light Bulb, the entire contents of each of which are incorporated herein by reference.

The elongate tray 110 may be characterized by a heat dissipation rate that equals or exceeds a combined heat generation rate of the plurality of moveable lighting packages 120. Referring again to FIG. 6, the elongate tray 110 may comprise a plurality of tray segments 610, 612, 614 each in thermal communication with a subset of the plurality of moveable lighting packages 120. Each of the tray segments 610, 612, 614 may have a heat dissipation rate of not less than a combined heat generation rate of the subset of the moveable lighting packages 120 with which a respective one of the tray segments 610, 612, 614 may make contact. The elongate tray 110 may be constructed of a heat-dissipating material such as thermoplastic, ceramic, porcelain, aluminum, and aluminum alloys.

Alternatively, or in addition, the elongate tray 110 may be configured to connect thermally to a housing 810 and/or a fixture 820 as illustrated in FIGS. 8 and 9. Such a configuration may cause the total available heat sink surface area to increase and, as a consequence, the heat-dissipation capacity of the combined elongate tray 110 and housing/fixture combination to increase. More specifically, a combined heat dissipation rate of the elongate tray 110 and of the housing 810 and/or fixture 820 may equal or exceed a combined heat generation rate of the plurality of moveable lighting packages 120.

Manufacturing and Installation

Figure 10:
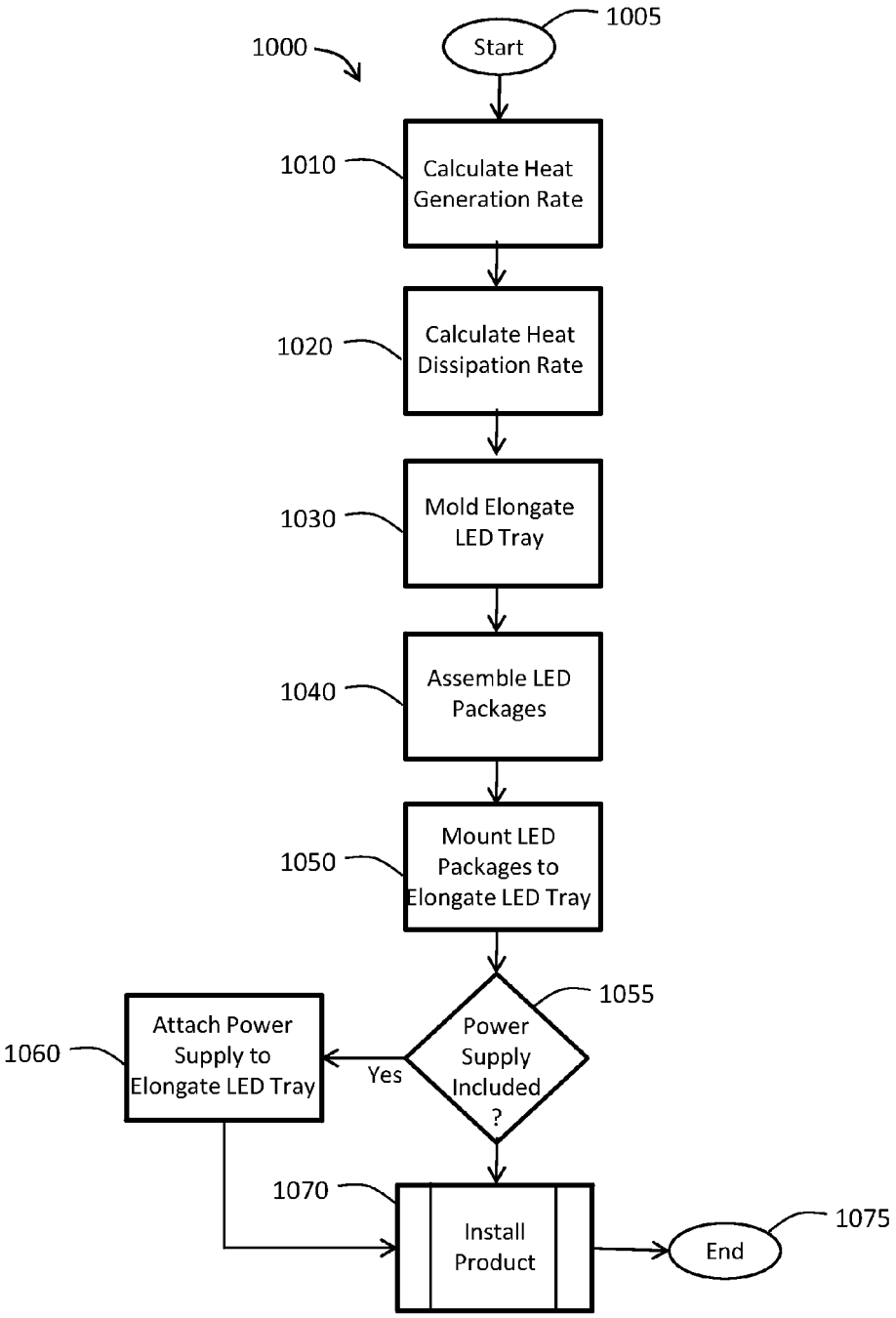
FIG. 10 is a flow chart detailing a method of manufacturing a linear light assembly according to an embodiment of the present invention.

Referring now to flow chart 1000 of FIG. 10, a method aspect for manufacturing a configurable linear light assembly 100 according to one embodiment of the present invention is discussed in detail. From the start 1005, the method may include the step of calculating a potential amount of heat generated by simultaneous operation of the plurality of moveable lighting packages 120 planned for inclusion in the linear light assembly 100 as designed (Block 1010). At Block 1020, the elongate tray 110 may be sized by calculating a potential amount of heat that may be dissipated by the planned surface area on the elongate tray 110 as designed. Next, the elongate tray 110 may be molded to a form having a surface area characterized by a heat dissipation rate of not less than the combined heat generation rate of the moveable lighting packages 120 planned for the design (Block 1030). The method may include attaching a plurality of optical assemblies 123 to a plurality of assembly trays 125 to create the moveable lighting packages 120 (Block 1040). For example, and without limitation, this step may include attaching the optic 442 in a position such that the optic 442 is in optical communication with the LEDs 444 which, in turn, may be in thermal and mechanical communication with a circuit board. The assembly tray 125 of each moveable lighting package 120 may be positioned in thermal and mechanical communication with the elongate tray 110 at Block 1050. If, at Block 1055, it is determined the manufactured product 100 is to include a power supply 230, then light sources 444 in the moveable lighting packages 120 may be positioned in electrical communication with the power supply 230 attached to the elongate tray 110 (Block 1060) before the product 100 is shipped to a consumer for installation at Block 1070. After product shipping, the process ends 1075.

Figure 11:
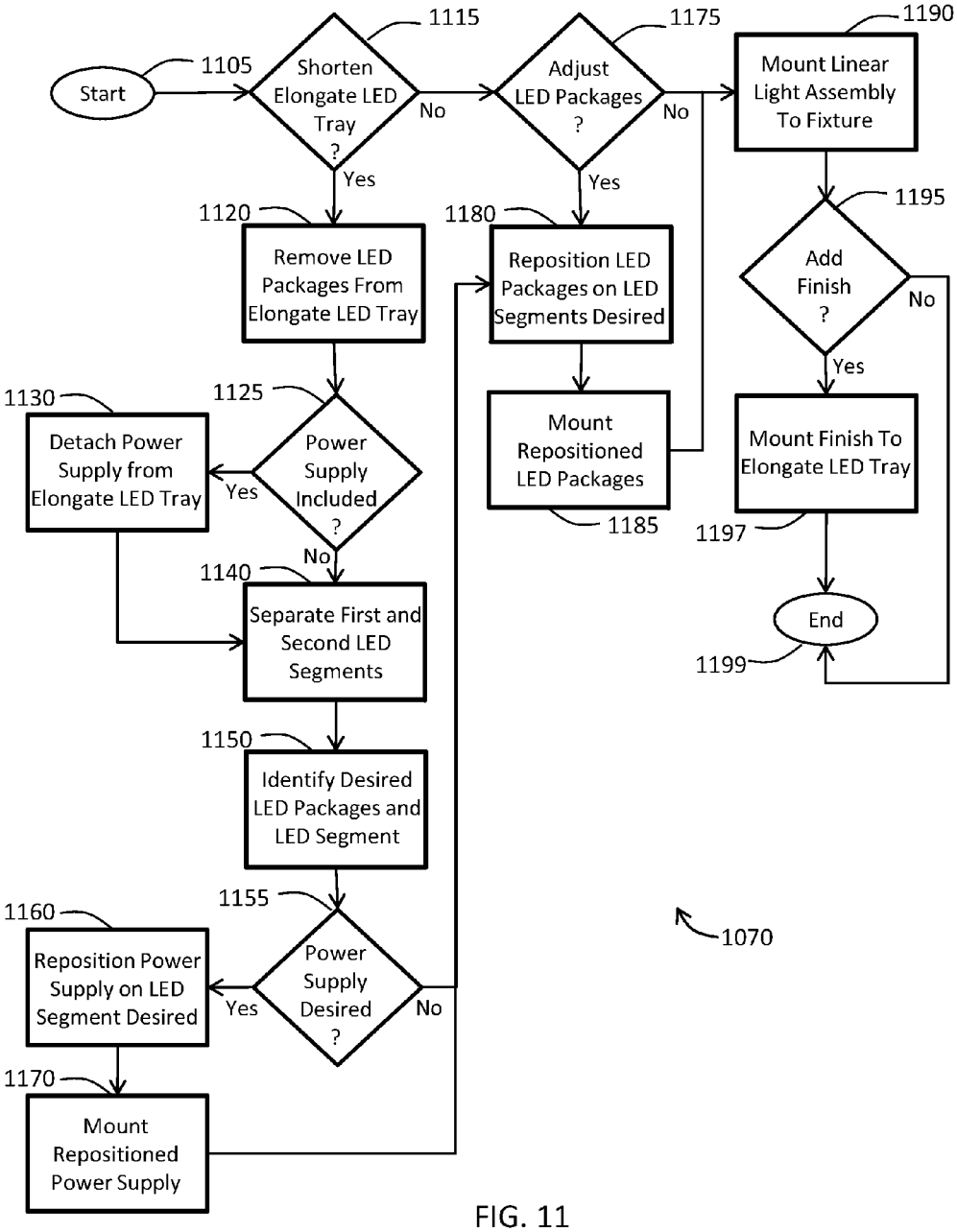
FIG. 11 is a flow chart detailing a method of installing a linear light assembly according to an embodiment of the present invention.

Referring now to flow chart 1070 of FIG. 11, a method aspect for installing a configurable linear light assembly 100 according to one embodiment of the present invention is discussed in detail. From the start 1105, the method may include the step of determining whether the linear light assembly 100 as designed must be reconfigured for a particular application (Block 1115). For example, and without limitation, reconfiguration may include shortening the elongate tray 110 of the assembly 100 to fit a preexisting fixture or mounting space. If the assembly 100 is to be reconfigured, then at Block 1120 the moveable lighting packages 120 that may have come preinstalled with the product as shipped may be removed from the elongate tray 110 to be modified. Similarly, if at Block 1125 a preinstalled power supply 230 is determined to be present, then the power supply 230 may be detached from the elongate tray 110 (Block 1130) in preparation for reconfiguration. Next, the elongate tray 110 may be reconfigured as desired at Block 1140. For example, and without limitation, the elongate tray 110 may be separated (e.g., by cutting) into a plurality of tray segments 610, 612, 614. At Block 1150, a subset of moveable lighting packages 120 and at least one of the tray segments 610, 612, 614 desired for reassembly may be identified (e.g., first tray segment 610). If at Block 1155, it is determined that a manufacturer-supplied power supply 230 is to be reused for the installation, then the power supply 230 may be repositioned (Block 1160) from the separated segment (e.g., second tray segment 612, 614) and mounted (Block 1170) on the desired first tray segment 610.

Still referring to FIG. 11, whether or not the elongate tray 110 is reconfigured after Block 1115, the position of the moveable lighting packages 120 may be adjusted on the elongate tray 110 (Block 1175). Adjusting the moveable lighting packages 120 may include moveably positioning each of the moveable lighting packages 120 on the medial channel portion 212 of the desired (remaining) first tray segment 610 (Block 1180), and affixing each of the desired moveable lighting packages 120 to a respective mounting assembly on the elongate tray 110 (Block 1185). For example, and without limitation, additional moveable lighting packages 120 may be provided by an OEM and attached to the elongate tray 110 in an after-market reconfiguration.

At Block 1190, the linear light assembly 100 may be mounted to a standard light fixture 820, whether or not that assembly 100 may have been shortened (Block 1115) and/or adjusted (Block 1175). At Block 1195, a determination may be made whether or not to add a housing 810, such as a finish, external to the linear light assembly 100. If not, the process ends at Block 1199. Otherwise, a housing 810 may be mounted to the configurable linear light assembly 100 (Block 1197) before the process ends at Block 1199.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. The scope of the invention should be determined by the appended claims and their legal equivalents, and not by the examples given. Therefore, it is understood that the invention is not to be limited to the specific embodiments disclosed.

What is claimed is:

1. A linear light assembly comprising:
an elongate tray comprising
a medial channel portion comprising
a track member having a substantially planar main body defining, on opposite sides thereof, generally flat front and rear sides, and defining, on a perimeter thereof, upper and lower edges, and
two opposing rim members adjacent to the upper and lower edges of the track member, respectively; and
first and second flange portions each comprising
a base member and
a plurality of fin members adjacent to the base member; and
a plurality of moveable lighting packages carried by and in thermal communication with the elongate tray, and each comprising
an assembly tray, and
an optical assembly carried by the assembly tray and comprising at least one light source.

2. A linear light assembly according to claim 1 wherein each rim member is longitudinally coextensive with the track member.

3. A linear light assembly according to claim 1 wherein each rim member is configured to project outward in a generally perpendicular direction with respect to the front side of the track member.

4. A linear light assembly according to claim 1 wherein each of the first and second flange portions is longitudinally coextensive with the track member.

5. A linear light assembly according to claim 1 wherein at least one of the first and second flange portions has a substantially U-shaped cross-section formed by the base member and the plurality of fin members;
wherein the base member of the U-shaped cross-section has a substantially planar central body defining, on opposite sides thereof, generally flat first and second sides, and defining, on a perimeter thereof, generally linear leading and trailing edges;
wherein the plurality of fin members of the U-shaped cross-section comprises two opposing fin members positioned adjacent to the leading and trailing edges of the base member, respectively, and each fin member is configured to project perpendicularly outward from the base member in a generally parallel direction with respect to the substantially planar main body of the track member.

6. A linear light assembly according to claim 5 wherein the second side of the base member of the U-shaped cross-section is attached to a respective rim member of the medial channel portion.

7. A linear light assembly according to claim 1 wherein the elongate tray is configured to have a plurality of mounting positions; wherein each of the plurality of mounting positions is suitable for mounting one of the plurality of moveable lighting packages so that each of the plurality of moveable lighting packages can be moveably positioned along the front side of the elongate track member.

8. A linear light assembly according to claim 1 wherein each of the plurality of moveable lighting packages is configured for removal from the front side of the track member independently of each other.

9. A linear light assembly according to claim 1 wherein the elongate tray comprises a plurality of tray segments each in mechanical and thermal communication with a subset of the plurality of moveable lighting packages; wherein a heat dissipation rate of each of the plurality of tray segments is not less than a combined heat generation rate of the subset of the plurality of moveable lighting packages.

10. A linear light assembly according to claim 1 wherein the elongate tray comprises at least one mounting assembly configured to receive a respective at least one of the plurality of moveable lighting packages; and wherein the at least one mounting assembly is of a type selected from the group consisting of fasteners, snap-fit connectors, and fitted grooves.

11. A linear light assembly according to claim 1 wherein the medial channel portion and the first and second flange portions are integrally molded as a monolithic unit; and wherein the optical assembly and the assembly tray are integrally molded as a monolithic unit.

12. A linear light assembly according to claim 1 wherein the elongate tray is configured to connect mechanically and thermally to a housing; and wherein a combined heat dissipation rate of the elongate tray and of the housing is not less than a combined heat generation rate of the plurality of moveable lighting packages in thermal communication with the elongate tray.

13. A linear light assembly according to claim 1 wherein the elongate tray is constructed of a heat-dissipating material selected from the group consisting of thermoplastic, ceramic, porcelain, aluminum, and aluminum alloys.

14. A linear light assembly according to claim 1 wherein the assembly tray and the track member form a generally central passageway therebetween configured to allow an electrical connection to pass from a power supply through an aperture in the track member and to extend through the central passageway to an electrical contact on the at least one light source.

15. A linear light assembly comprising:
an elongate tray configured to have a plurality of mounting positions and comprising
a medial channel portion comprising
a track member having a substantially planar main body defining, on opposite sides thereof, generally flat front and rear sides, and defining, on a perimeter thereof, upper and lower edges, and
two opposing rim members adjacent to the upper and lower edges of the track member, respectively, wherein each rim member is longitudinally coextensive with the track member; and
first and second flange portions each having a base member and a plurality of fin members adjacent to the base member so as to form a substantially U-shaped cross section, each of the first and second flange portions being longitudinally coextensive with the track member,
a plurality of moveable lighting packages carried by and in thermal communication with the elongate tray, and each comprising an assembly tray, and an optical assembly carried by the assembly tray and comprising at least one light emitting diode (LED);

wherein each of the plurality of mounting positions on the elongate tray is suitable for mounting one of the plurality of moveable lighting packages so that each of the plurality of moveable lighting packages can be moveably positioned along the front side of the elongate track member.

16. A linear light assembly according to claim 15 wherein the elongate tray is constructed of a heat-dissipating material selected from the group consisting of thermoplastic, ceramic, porcelain, aluminum, and aluminum alloys.

17. A linear light assembly according to claim 15 wherein the elongate tray comprises a plurality of tray segments each in mechanical and thermal communication with a subset of the plurality of moveable lighting packages; wherein a heat dissipation rate of each of the plurality of tray segments is not less than a combined heat generation rate of the subset of the plurality of moveable lighting packages.

18. A method of installing a linear light assembly comprising an elongate tray in mechanical and thermal communication with each of a plurality of moveable lighting packages, the elongate tray characterized by a plurality of mounting positions suitable for mounting of one of the plurality of moveable lighting packages, and comprising a medial channel portion comprising a track member having a substantially planar main body defining on opposite sides thereof generally flat front and rear sides and defining on a perimeter thereof upper and lower edges, and two opposing rim members adjacent to the upper and lower edges of the track member, respectively; and first and second flange portions each comprising a base member and a plurality of fin members adjacent to the base member; and each of the plurality of moveable lighting packages comprising an assembly tray and an optical assembly carried by the assembly tray and comprising at least one light source; the method comprising:

adjustably positioning each of the moveable lighting packages on the medial channel portion of the elongate tray;

affixing the each of the plurality of moveable lighting packages to a respective mounting position.

19. A method according to claim 18 wherein the elongate tray further comprises first and second tray segments; the method further comprising:

moving each of a first subset of the plurality of moveable lighting packages to a respective mounting position on the first tray segment;

removing each of a second subset of the plurality of moveable lighting packages from the second tray segment;

mechanically separating the second tray segment and the first tray segment;

mounting the first tray segment to a light fixture.

20. A method according to claim 19 wherein mechanically separating the second tray segment and the first tray segment comprises cutting the elongate tray; and further comprising removing the power supply from the second tray segment and mounting the power supply to the first tray segment.

* * * * *